US011322856B2

(12) United States Patent
Kim et al.

(10) Patent No.: US 11,322,856 B2
(45) Date of Patent: May 3, 2022

(54) ARRAY ANTENNA

(71) Applicant: Samsung Electro-Mechanics Co., Ltd., Suwon-si (KR)

(72) Inventors: Jae Yeong Kim, Suwon-si (KR); Ji Hyung Jung, Suwon-si (KR); Chin Mo Kim, Suwon-si (KR); Sung Nam Cho, Suwon-si (KR); Sung Yong An, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 29 days.

(21) Appl. No.: 16/732,661

(22) Filed: Jan. 2, 2020

(65) Prior Publication Data

US 2021/0066814 A1 Mar. 4, 2021

(30) Foreign Application Priority Data

Sep. 4, 2019 (KR) ..... 10-2019-0109396

(51) Int. Cl.

| | |
|---|---|
| ***H01Q 21/06*** | (2006.01) |
| ***H01Q 1/52*** | (2006.01) |
| ***H01Q 1/22*** | (2006.01) |
| ***H01Q 1/38*** | (2006.01) |

(52) U.S. Cl.

CPC ..... *H01Q 21/065* (2013.01); *H01Q 1/2283* (2013.01); *H01Q 1/38* (2013.01); *H01Q 1/526* (2013.01)

(58) Field of Classification Search

CPC .... H01Q 21/065; H01Q 1/526; H01Q 1/2283; H01Q 1/38; H01Q 9/0407; H01Q 23/00; H01Q 1/243; H01Q 21/0025; H01Q 1/521

See application file for complete search history.

(56) References Cited

U.S. PATENT DOCUMENTS

| | | | | |
|---|---|---|---|---|
| 6,215,454 | B1 * | 4/2001 | Tran | H01Q 1/243 343/702 |
| 10,938,091 | B1 * | 3/2021 | Cho | H01Q 1/243 |
| 2016/0056544 | A1 * | 2/2016 | Garcia | H01Q 1/38 343/725 |
| 2019/0027802 | A1 * | 1/2019 | Noori | H01Q 3/30 |
| 2019/0027804 | A1 | 1/2019 | Kim et al. | |
| 2019/0229398 | A1 * | 7/2019 | Ryoo | H01Q 1/243 |
| 2019/0245275 | A1 * | 8/2019 | Hayashi | H01Q 5/42 |
| 2019/0305402 | A1 * | 10/2019 | Dalmia | H01Q 1/2283 |
| 2019/0319338 | A1 * | 10/2019 | Gu | H01L 21/4857 |
| 2019/0319367 | A1 * | 10/2019 | Edwards | H01Q 1/243 |
| 2019/0333882 | A1 * | 10/2019 | Kamgaing | H01Q 19/005 |
| 2020/0014113 | A1 * | 1/2020 | Asaka | H01Q 21/065 |

(Continued)

FOREIGN PATENT DOCUMENTS

| | | | |
|---|---|---|---|
| KR | 10-1014352 | B1 | 2/2011 |
| KR | 10-2019-0009232 | A | 1/2019 |

*Primary Examiner* — David E Lotter

(74) *Attorney, Agent, or Firm* — NSIP Law

(57) ABSTRACT

An array antenna includes an antenna substrate including a first ceramic member, an insertion member and a second ceramic member sequentially stacked, antenna pattern portions arranged on the antenna substrate in an array form, and shielding vias disposed inside the antenna substrate and extending in a thickness direction of the antenna substrate. The shielding vias are disposed in thickness areas of the antenna substrate corresponding to the antenna pattern portions.

22 Claims, 18 Drawing Sheets

(56) References Cited

U.S. PATENT DOCUMENTS

| | | | | |
|---|---|---|---|---|
| 2020/0021010 | A1* | 1/2020 | Ou | H01Q 1/243 |
| 2020/0259267 | A1* | 8/2020 | Park | H01Q 1/48 |
| 2020/0313279 | A1* | 10/2020 | Kim | H01Q 1/2283 |
| 2020/0328530 | A1* | 10/2020 | Park | H01Q 21/065 |
| 2020/0335870 | A1* | 10/2020 | Kim | H01Q 9/0414 |
| 2020/0411986 | A1* | 12/2020 | Cooper | H01Q 1/48 |
| 2021/0036433 | A1* | 2/2021 | Kim | H01Q 21/0075 |
| 2021/0050651 | A1* | 2/2021 | Jung | H01Q 19/30 |

* cited by examiner

ARRAY ANTENNA

CROSS-REFERENCE TO RELATED APPLICATION(S)

This application claims the benefit under 35 USC 119(a) of Korean Patent Application No. 10-2019-0109396 filed on Sep. 4, 2019 in the Korean Intellectual Property Office, the entire disclosure of which is incorporated herein by reference for all purposes.

BACKGROUND

1. Field

The following description relates to an array antenna.

2. Description of Background

Fifth generation (5G) communication systems are implemented in higher frequency (mmWave) bands, such as 10 Ghz to 100 GHz bands, to obtain higher data rates. To reduce propagation loss of RF signals and increase transmission distance, large-scale scale antenna techniques, such as beamforming, large-scale multiple-input multiple-output (MIMO), full dimensional multiple-input multiple-output (MIMO), array antennas, and analog beamforming, are discussed in relation to 5G communication systems.

On the other hand, with regard to mobile communication terminals such as mobile phones, personal data/digital assistants (PDAs), navigation, notebooks that support wireless communications, a trend of adding functions such as code division multiple access (CDMA), wireless local area network (LAN), digital multimedia broadcasting (DMB), and Near Field Communication (NFC) is developing. One of the important aspects of enabling such functions is the antenna.

However, in the GHz band to which the 5G communication system is applied, it is difficult to use the related art antenna because the wavelength is reduced to just a few mm. Therefore, there is a demand for an array antenna module which is very small in size to be mounted in a mobile communication terminal and which is suitable for the GHz band.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Examples provide an array antenna in which interference between unit antennas arranged in an array form may be reduced.

In one general aspect, an array antenna includes an antenna substrate including a first ceramic member, an insertion member and a second ceramic member sequentially stacked, antenna pattern portions arranged on the antenna substrate in an array form, and shielding vias disposed inside the antenna substrate and extending in a thickness direction of the antenna substrate. The shielding vias are disposed in thickness areas of the antenna substrate corresponding to the antenna pattern portions.

Each of the antenna pattern portions, and unit regions of the antenna substrate corresponding to the antenna pattern portions, may define a plurality of unit antennas.

The shielding vias may be disposed between adjacent unit antennas.

The shielding vias may be disposed along a boundary between the adjacent unit antennas, and distances of the boundary from antenna pattern portions of the adjacent unit antennas may be equal to each other.

The shielding vias may be arranged to surround each of the unit antennas.

The shielding vias may be disposed to surround each of the unit antennas such that adjacent unit antennas share a portion of the shielding vias such that shielding vias corresponding to each of the adjacent unit antennas do not overlap.

Each of the antenna pattern portions may include a first patch disposed on a first surface of the first ceramic member; and a second patch disposed on a first surface of the second ceramic member facing the first ceramic member.

The shielding vias may extend from the first surface of the first ceramic member to the first surface of the second ceramic member.

Each of the antenna pattern portions may include a first patch provided on a first surface of the first ceramic member; and a second patch provided on a second surface of the second ceramic member opposite to the first ceramic member.

The shielding vias may extend from the first surface of the first ceramic member to the second surface of the second ceramic member.

The shielding vias may extend from the first surface of the first ceramic member to a position corresponding to a thickness of the second patch to protrude from the second ceramic member.

In another general aspect, an array antenna includes an antenna substrate including a first ceramic member, an insertion member, and a second ceramic member sequentially stacked; antenna pattern portions arranged on the antenna substrate in an array form; and shielding electrodes disposed on the first ceramic member and the second ceramic member. Each of the antenna pattern portions, and unit regions of the antenna substrate corresponding to the antenna pattern portions, form a plurality of unit antennas, and the shielding electrodes are disposed between adjacent unit antennas.

The shielding electrodes may be disposed along a boundary between the adjacent unit antennas, and distances of the boundary from antenna pattern portions of the adjacent unit antennas may be equal to each other.

The shielding electrodes may be disposed to surround each of the unit antennas.

The shielding electrodes may be disposed to surround each of the unit antennas such that the adjacent unit antennas share a portion of the shielding electrodes such that shielding electrodes corresponding to each of the adjacent unit antennas do not overlap.

Each of the unit antennas may include a first patch disposed on the first ceramic member; and a second patch disposed on the second ceramic member.

The shielding electrodes may include a first shielding electrodes disposed on a same layer of the antenna substrate as a layer of the first patch, and second shielding electrodes disposed on a same layer of the antenna substrate as a layer of the second patch.

In another general aspect, an array antenna includes an antenna substrate including a first ceramic layer, a second ceramic layer disposed on the first ceramic layer, and an insertion layer disposed between the first ceramic layer and the second ceramic layer; unit antennas disposed on the antenna substrate, each unit antenna including a first patch disposed at a boundary between the first ceramic layer and the insertion layer and a second patch disposed on a surface of the second ceramic layer and at least partially overlapping the first patch in a thickness direction of the antenna substrate; and shielding elements disposed at least partially inside the antenna substrate and between adjacent unit antennas, the shielding elements at least partially overlapping each of the first patches in at least one direction orthogonal to the thickness direction of the antenna substrate.

The shielding elements may include shielding vias that extend from a surface of the first ceramic layer that forms the boundary between the first ceramic layer and the insertion layer to the surface of the second ceramic layer on which the second patch is disposed.

The shielding elements may include first shielding electrodes disposed at a boundary between the between the first ceramic layer and the insertion layer and second electrodes disposed on the surface of the second ceramic layer on which the second patch is disposed.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative sizes, proportions, and depictions of elements in the drawings may be exaggerated for clarity, illustration, and convenience.

DETAILED DESCRIPTION

Figure 1:
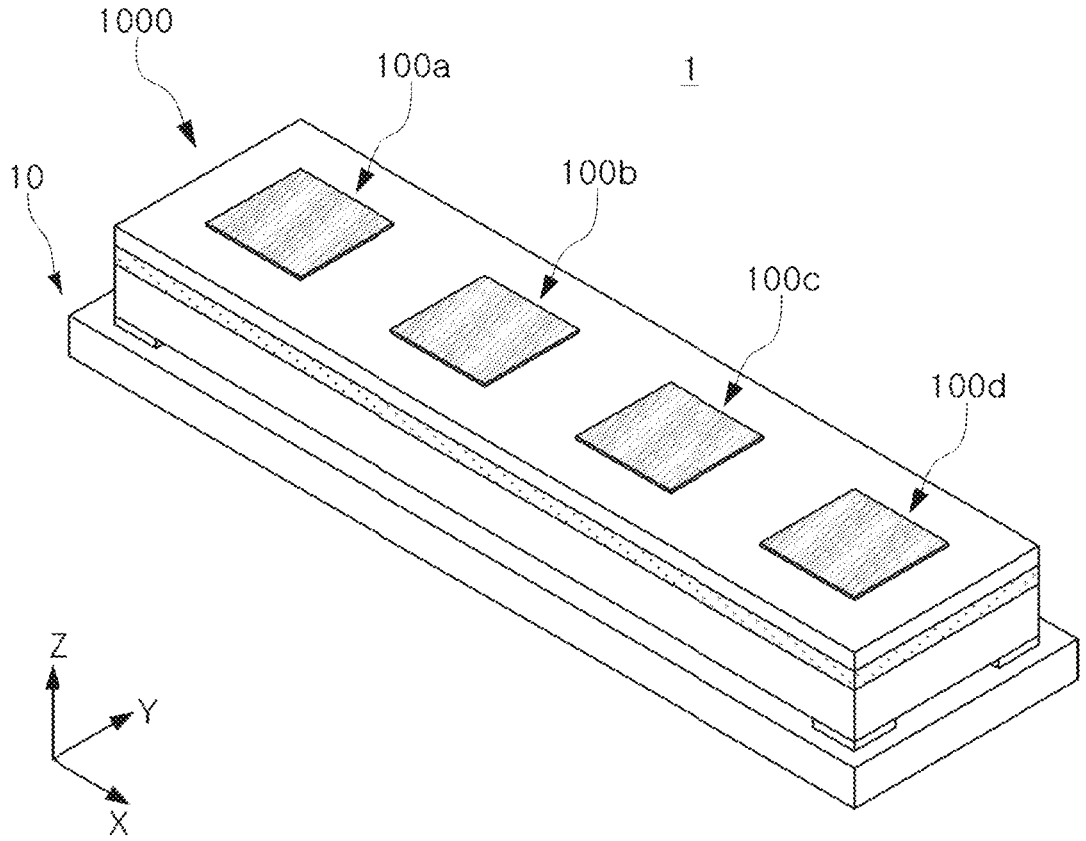
FIG. 1 is a perspective view of an array antenna module according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that would be well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will fully convey the scope of the disclosure to one of ordinary skill in the art.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there may be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as illustrated in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes illustrated in the drawings may occur. Thus, the examples described herein are not limited to the specific shapes illustrated in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

The drawings may not be to scale, and the relative size, proportions, and depiction of elements in the drawings may be exaggerated for clarity, illustration, and convenience.

Subsequently, examples are described in further detail with reference to the accompanying drawings.

An array antenna module according to an example may operate in a high frequency region and may operate in, for example, a frequency band of 3 GHz or more. The array antenna module described herein may be mounted on an electronic device configured to receive or to transmit and receive an RF signal. For example, a unit antenna may be mounted on a portable telephone, a portable notebook, a drone, or the like.

Figure 2:
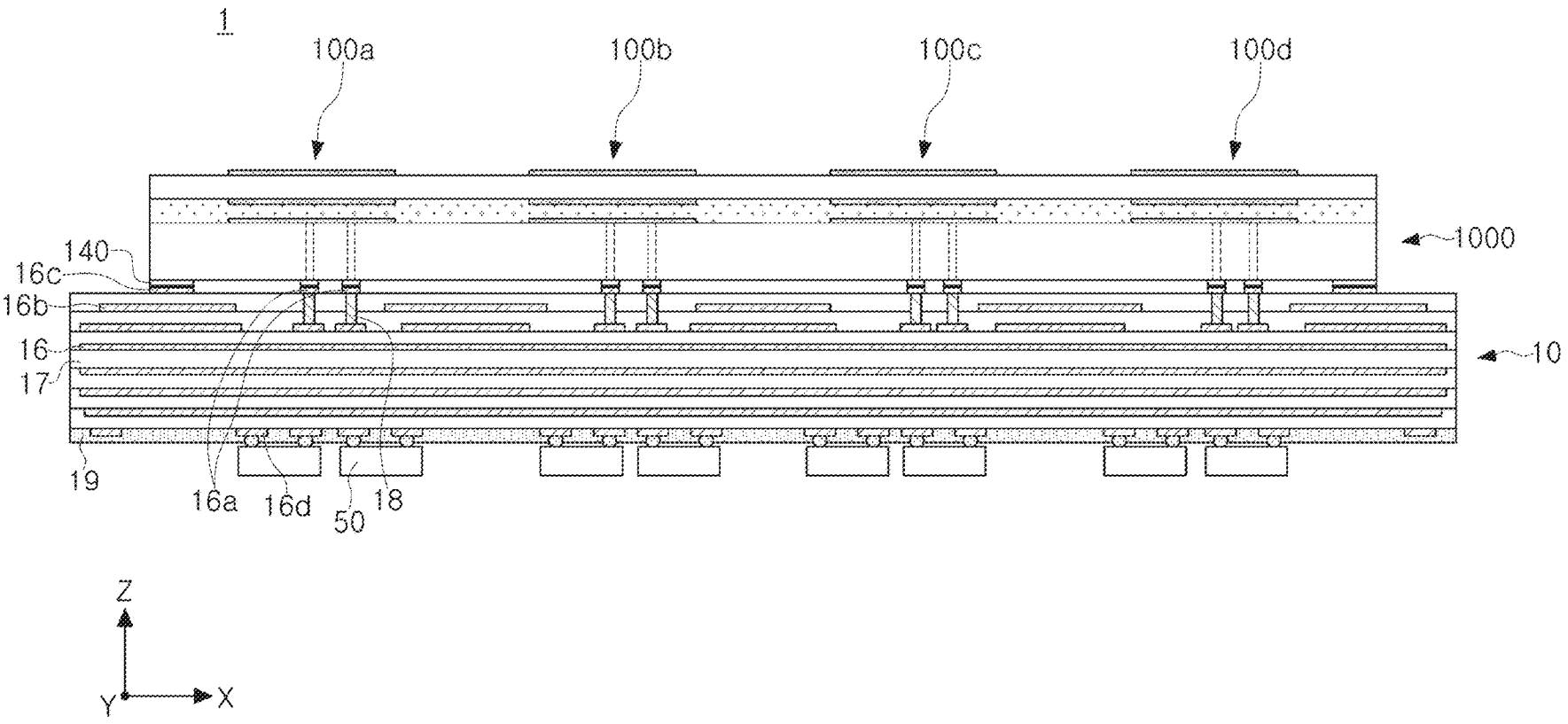
FIG. 2 is a cross-sectional view of the array antenna module of FIG. 1.

FIG. 1 is a perspective view of an array antenna module according to an example, and FIG. 2 is a cross-sectional view of the array antenna module of FIG. 1.

Referring to FIGS. 1 and 2, an array antenna module 1 according to an example may include a mounting board 10, an electronic device 50, and an array antenna 1000. At least one electronic device 50 and the array antenna 1000 may be disposed on the mounting board 10.

The mounting board 10 may be a circuit board on which circuits or electronic components required for the array antenna 1000 are mounted. For example, the mounting board 10 may be a printed circuit board (PCB) having one or more electronic components mounted on a surface thereof. Therefore, the mounting board 10 may be provided with circuit wiring for electrically connecting electronic components. The mounting board 10 may be implemented as a flexible substrate, a ceramic substrate, a glass substrate, or the like. The mounting board 10 may be comprised of a plurality of layers. The mounting board 10 may be formed of a multilayer substrate formed by alternately stacking at least one insulating layer 17 and at least one wiring layer 16. The at least one wiring layer 16 may include two outer layers provided on one surface and the other surface of the mounting board 10 and at least one inner layer provided between the two outer layers. As an example, the insulating layer 17 may be formed of an insulating material such as prepreg, Ajinomoto build-up film (ABF), FR-4, and bismaleimide triazine (BT). The insulating material may be formed of a thermosetting resin such as an epoxy resin, a thermoplastic resin such as polyimide, or a resin formed by impregnating these resins with a core material such as glass fiber, glass cloth, glass fabric, or the like. In some examples, the insulating layer 17 may be formed of a photoimageable dielectric resin.

The wiring layer 16 electrically connects a plurality of the electronic devices 50 and the array antenna 1000. The wiring layer 16 may electrically connect the plurality of electronic devices 50 and the array antenna 1000 externally.

The wiring layer 16 may be formed of a conductive material such as copper (Cu), aluminum (Al), silver (Ag), tin (Sn), gold (Au), nickel (Ni), lead (Pb), titanium (Ti), alloys thereof, or the like.

In the insulating layer 17, wiring vias 18 are disposed to interconnect the wiring layers 16.

The array antenna 1000 is mounted on one surface of the mounting board 10, for example, an upper surface (in the Z-axis direction) of the mounting board 10. The array antenna 1000 may include a plurality of unit antennas 100*a*, 100*b*, 100*c* and 100*d*. The array antenna 1000 has a width extending in a Y-axis direction, a length extending in an X-axis direction, and a thickness or height extending in a Z-axis direction.

A feed pad 16*a* is provided on the upper surface of the mounting board 10 to provide a feed signal to the plurality of unit antennas 100*a*, 100*b*, 100*c* and 100*d* of the array antenna 1000. A ground layer 16*b* is provided in any one inner layer of a plurality of layers of the mounting board 10. As an example, the wiring layer 16 disposed on a lower layer closest to the upper surface of the substrate 10 is used as the ground layer 16*b*. The ground layer 16*b* operates as a reflector of the plurality of unit antennas 100*a*, 100*b*, 100*c* and 100*d* of the array antenna 1000. Therefore, the ground layer 16*b* may concentrate radio frequency (RF) signals by reflecting the RF signals output from the plurality of unit antennas 100*a*, 100*b*, 100*c* and 100*d* of the array antenna 1000 in the Z-axis direction corresponding to a directing direction.

In FIG. 2, the ground layer 16*b* is illustrated as being disposed in a lower layer closest to the upper surface of the substrate 10. However, according to an example, the ground layer 16*b* may be provided on the upper surface of the substrate 10 and may also be provided in other layers.

An upper surface pad 16*c* bonded to the array antenna 1000 is provided on the upper surface of the mounting board 10. The electronic device 50 may be mounted on the other surface of the mounting board 10, for example, a lower surface of the mounting board 10 opposite the upper surface. The lower surface of the mounting board 10 is provided with a lower surface pad 16*d* that is electrically connected to the electronic element 50.

An insulating protective layer 19 may be disposed on the lower surface of the mounting board 10. The insulating protective layer 19 is disposed in such a manner as to cover the insulating layer 17 and the wiring layer 16 on the lower surface of the mounting board 10, thereby protecting the wiring layer 16 disposed on the lower surface of the insulating layer 17. For example, the insulating protective layer 19 may include an insulating resin and an inorganic filler. The insulating protection layer 19 may have one or more openings that exposes at least a portion of the wiring layer 16. The electronic device 50 may be mounted on the lower surface pad 16*d* through solder balls disposed in the openings.

In the related art, to secure sufficient antenna characteristics of a patch antenna implemented in a pattern form in a multilayer substrate, a plurality of layers is required in the substrate, which causes a problem in which the volume of the patch antenna is excessively increased. The problem is solved by disposing an insulator having a relatively high dielectric constant in the multilayer substrate to reduce a thickness of an insulator and reduce the size and thickness of an antenna pattern.

However, in a case in which the dielectric constant of the insulator is increased, the wavelength of an RF signal is shortened, such that the RF signal is trapped in the insulator having a high dielectric constant, resulting in a significant reduction in radiation efficiency and gain of the RF signal.

According to an example herein, the dielectric constant of ceramic members included in the array antenna 1000 is higher than a dielectric constant of the insulating layer included in the mounting board 10, thereby miniaturizing the array antenna 1000.

Furthermore, a material having a lower dielectric constant than those of the ceramic members may be disposed between the ceramic members of the array antenna 1000 to lower an overall dielectric constant of the array antenna 1000.

As a result, the wavelength of the RF signal may be increased while miniaturizing the array antenna module 1, thereby improving radiation efficiency and gain. In this case, the overall dielectric constant of the array antenna 1000 may be understood as a dielectric constant formed by the ceramic members of the array antenna 1000 and a material disposed between the ceramic members. Therefore, when a material having a lower dielectric constant than that of the ceramic members is disposed between the ceramic members, the overall dielectric constant of the array antenna 1000 may be lower than that of the ceramic members.

Figure 3:
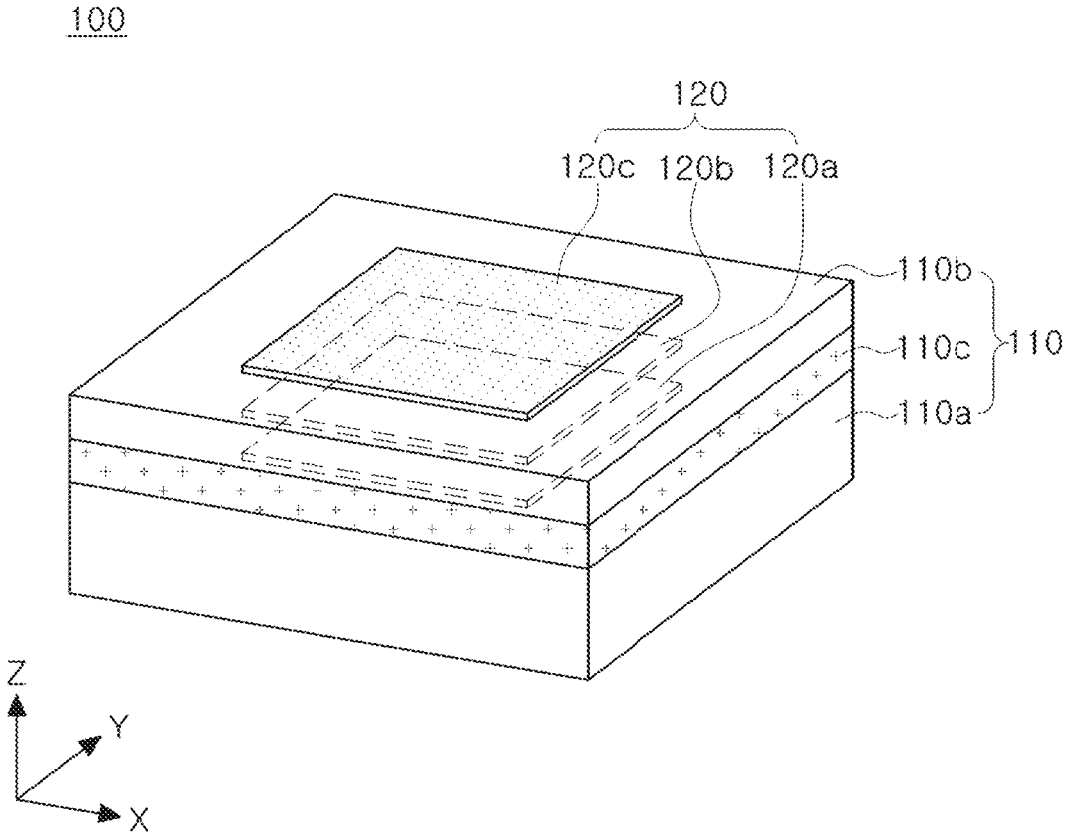
FIG. 3 is a perspective view of a unit antenna according to an example.
Figure 4:
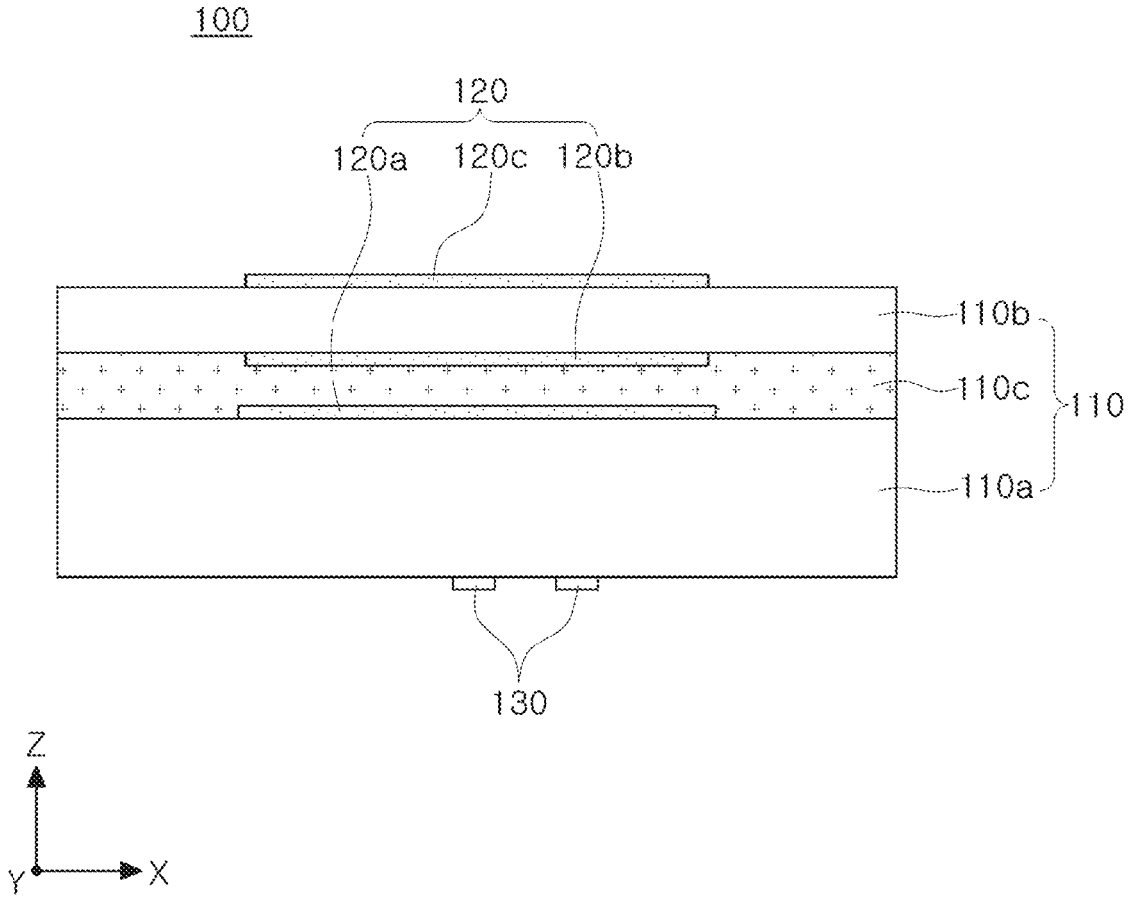
FIG. 4 is a side view of the unit antenna of FIG. 3.
Figure 5:
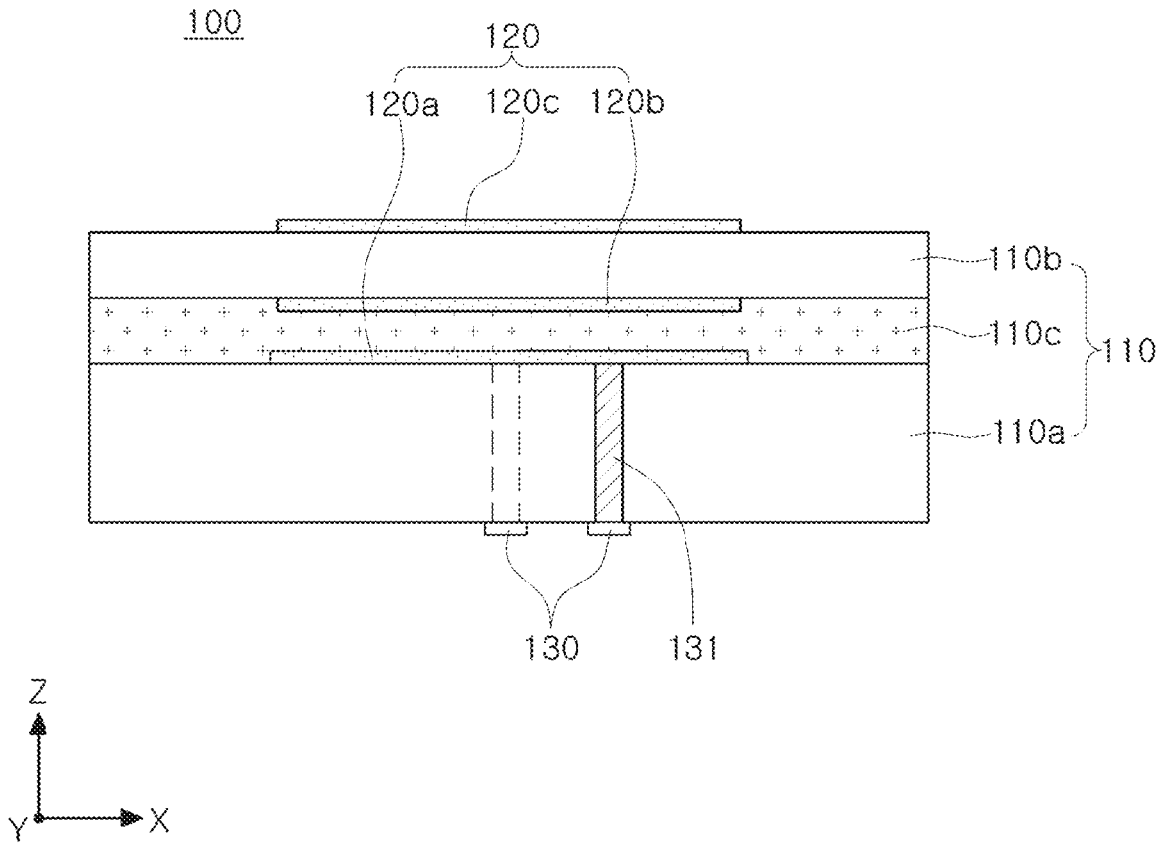
FIG. 5 is a cross-sectional view of the unit antenna of FIG. 3.

FIG. 3 is a perspective view of a unit antenna according to an example, FIG. 4 is a side view of the unit antenna of FIG. 3, and FIG. 5 is a cross-sectional view of the unit antenna of FIG. 3.

A unit antenna 100 illustrated in FIGS. 3, 4 and 5 corresponds to one of the plurality of unit antennas 100*a*, 100*b*, 100*c* and 100*d* of the array antenna 1000 illustrated in FIG. 1.

Referring to FIGS. 3, 4 and 5, the unit antenna 100 according to an example may include an antenna substrate 110 and an antenna pattern portion 120 provided on the antenna substrate 110.

The antenna substrate 110 includes a first ceramic member 110*a*, a second ceramic member 110*b*, and an insertion member 110*c* that are sequentially stacked, and the antenna pattern portion 120 includes a first patch 120*a* and may include at least one of a second patch 120*b* and a third patch 120*c*.

Among the plurality of unit antennas 100*a*, 100*b*, 100*c* and 100*d*, a first patch 120*a*, a second patch 120*b* and a third patch 120*c* included in first unit antenna 100*a* may be referred to as a first antenna pattern portion; a first patch 120*a*, a second patch 120*b* and a third patch 120*c* included in second unit antenna 100*b* may be referred to as a second antenna pattern portion; a first patch 120*a*, a second patch 120*b* and a third patch 120*c* included in third unit antenna 100*c* may be referred to as a third antenna pattern portion; and a first patch 120*a*, a second patch 120*b* and a third patch 120*c* included in fourth unit antenna 100*d* may be referred to as a fourth antenna pattern portion.

The plurality of unit antennas is defined by one antenna pattern portion among the first antenna pattern portion, the second antenna pattern portion, the third antenna pattern portion and the fourth antenna pattern portion, and a plurality of unit areas of the antenna substrate corresponding to the one antenna pattern portion.

The first patch 120*a* is formed of a flat plate metal having a predetermined area. For example, the first patch 120*a* is formed to have a quadrangular shape. According to examples, the first patch 120*a* may be formed to have various shapes such as a polygonal shape and a circular shape. The first patch 120*a* may be connected to a feed via 131 to function and operate as a feed patch.

The second patch 120*b* and the third patch 120*c* are spaced apart from the first patch 120*a* by a predetermined distance, and are formed of a metal having a flat plate shape with a predetermined area. The second patch 120*b* and the third patch 120*c* have the same as or different area from that of the first patch 120*a*. For example, the second patch 120*b* and the third patch 120*c* may be formed to have a smaller area than that of the first patch 120*a* and may be disposed on the first patch 120*a*. For example, the second patch 120*b* and the third patch 120*c* may be formed to be 5% to 8% smaller than the first patch 120*a*. As an example, the thickness of the first patch 120*a*, the second patch 120*b*, and the third patch 120C may each be 20 μm.

The second patch 120*b* and the third patch 120*c* may be electromagnetically coupled with the first patch 120*a* to function and operate as a radiation patch. The second patch 120*b* and the third patch 120*c* may further concentrate the RF signal in the Z direction corresponding to a mounting direction of the array antenna 1000 to improve the gain or bandwidth of the first patch 120*a*. The unit antenna 100 may include at least one of the second patch 120*b* and the third patch 120*c* that function as radiation patches.

The first patch 120*a*, the second patch 120*b* and the third patch 120*c* may be formed of one selected from silver (Ag), gold (Au), copper (Cu), aluminum (Al), platinum (Pt), titanium (Ti), molybdenum (Mo), nickel (Ni) and tungsten (W), or may be formed of an alloy of two or more thereof. The first patch 120*a*, the second patch 120*b* and the third patch 120*c* may be formed of a conductive paste or a conductive epoxy.

In some examples, on the first patch 120*a*, the second patch 120*b* and the third patch 120*c*, a plating layer may be additionally formed in the form of a film along respective surfaces of the first patch 120*a*, the second patch 120*b* and the third patch 120*c*. The plating layer may be formed on respective surfaces of the first patch 120*a*, the second patch 120*b* and the third patch 120*c* through a plating process. The plating layer may be formed by sequentially laminating a nickel (Ni) layer and a tin (Sn) layer, or by sequentially laminating a zinc (Zn) layer and a tin (Sn) layer. In an example, the plating layer may be formed of one selected from copper (Cu), nickel (Ni) and tin (Sn), or may be formed of an alloy of two or more thereof.

The plating layer is formed on each of the first patch 120*a*, the second patch 120*b* and the third patch 120*c* to prevent oxidation of the first patch 120*a*, the second patch 120*b* and the third patch 120*c*. The plating layer may also be formed along surfaces of a feed pad 130, the feed via 131 and a bonding pad 140 (see bonding pad 140 in FIG. 2).

The first ceramic member 110*a* may be formed of a dielectric having a predetermined dielectric constant. For example, the first ceramic member 110*a* may be formed of a ceramic sintered body having a hexahedral shape. The first ceramic member 110*a* may include magnesium (Mg), silicon (Si), aluminum (Al), calcium (Ca), and titanium (Ti). As an example, the first ceramic member 110*a* may include Mg2SiO4, MgAl2O4, and CaTiO3. As another example, the first ceramic member 110*a* may further include MgTiO3 in addition to Mg2SiO4, MgAl2O4, and CaTiO3, and according to an example, MgTiO3 replaces CaTiO3, so that the first ceramic member 110*a* includes Mg2SiO4, MgAl2O4, and MgTiO3.

When a distance between the ground layer 16*b* of the array antenna module 1 and the first patch 120*a* of the unit antenna 100 corresponds to λ/10 to λ/20, the ground layer 16*b* may efficiently reflect the RF signal output by the unit antenna 100 in the directing direction.

When the ground layer 16*b* is provided on the upper surface of the mounting board 10, the distance between the ground layer 16*b* of the array antenna module 1 and the first patch 120*a* of the unit antenna 100 is substantially the same as a sum of thicknesses of the first ceramic member 110*a*, the bonding pad 140 and the upper surface pad 16*c*.

Therefore, the thickness of the first ceramic member 110*a* may be determined depending on a design distance λ/10 to λ/20 of the ground layer 16*b* and the first patch 120*a*. For example, the thickness of the first ceramic member 110*a* may correspond to 90 to 95% of λ/10 to λ/20. For example, when a dielectric constant of the first ceramic member 110*a* is 5 to 12 at 28 GHz, the thickness of the first ceramic member 110*a* may be 150 to 500 μm.

The first patch 120*a* is provided on one surface of the first ceramic member 110*a*, and the feed pad 130 is provided on the other surface (opposite surface) of the first ceramic member 110*a*. In the case of the feed pad 130, at least one feed pad may be provided on the other surface of the first ceramic member 110*a*. The feed pad 130 may have a thickness of 20 μm.

The feed pad 130 provided on the other surface of the first ceramic member 110*a* is electrically connected to the feed pad 16*a* provided on one surface of the mounting board 10. The feed pad 130 is electrically connected to the feed via 131 penetrating through the first ceramic member 110*a* in a thickness direction, and the feed via 131 may provide a feed signal to the first patch 110*a* provided on one surface of the first ceramic member 110*a*. In the case of the feed via 131, at least one feed via may be provided. As an example, two feed vias 131 may be provided to correspond to two feed pads 130. One feed via 131 of the two feed vias 131 corresponds to a feed line for generating vertical polarization, and the other feed via 131 corresponds to a feed line for generating horizontal polarization. A diameter of the feed via 131 may be 150 μm.

Referring to FIG. 2, the bonding pad 140 is provided on the other surface of the first ceramic member 110*a*. The bonding pad 140 may be provided at respective corner regions of the array antenna 1000. According to an example, bonding pads 140 may be provided along respective four sides of the array antenna 1000 having a quadrangular shape, and in addition, may be disposed in various forms.

The bonding pads 140 provided on the other surface of the first ceramic member 110*a* are mutually bonded to upper surface pads 16*c* provided on one surface of the mounting board 10. As an example, the bonding pads 140 may be bonded to the upper surface pads 16*c* of the mounting board 10 through solder paste. A thickness of the bonding pad 140 may be 20 μm.

The second ceramic member 110*b* may be formed of a dielectric having a predetermined dielectric constant. For example, the second ceramic member 110*b* may be formed of a ceramic sintered body having a hexahedral shape similar to that of the first ceramic member 110*a*. The second ceramic member 110*b* may have the same dielectric constant as that of the first ceramic member 110*a*, and according to examples, may have a dielectric constant different from that of the first ceramic member 110*a*. For example, the dielectric constant of the second ceramic member 110*b* may be higher than that of the first ceramic member 110*a*.

According to an example, when the dielectric constant of the second ceramic member 110*b* is higher than that of the first ceramic member 110*a*, the RF signal is radiated toward the second ceramic member 110*b* having a relatively high dielectric constant, thereby improving the gain of the RF signal.

The second ceramic member 110*b* may have a thickness less than that of the first ceramic member 110*a*. In examples, the second ceramic member 110*b* may have the same thickness as that of the first ceramic member 110*a*.

The thickness of the first ceramic member 110*a* may correspond to 1 to 5 times, for example, 2 to 3 times the thickness of the second ceramic member 110*b*. As an example, the thickness of the first ceramic member 110*a* may be 150 to 500 μm, and the thickness of the second ceramic member 110*b* may be 100 to 200 μm, and for example, may be 50 to 200 μm. According to an example, depending on the thickness of the second ceramic member 110*b*, the first patch 120*a* and the second patch 120*b*/third patch 120*c* may maintain an appropriate distance, thereby improving radiation efficiency of the RF signal.

The dielectric constant of the first ceramic member 110*a* and the second ceramic member 110*b* may be higher than that of the mounting board 10, for example, a dielectric layer of the insulating layer 17 provided on the mounting board 10.

As an example, the dielectric constants of the first ceramic member 110*a* and the second ceramic member 110*b* may be 5 to 12 at 28 GHz, and the dielectric constant of the mounting board 10 may be 3 to 4 at 28 GHz. As a result, the volume of the unit antenna 100 may be reduced, thereby miniaturizing an overall array antenna module 1.

The second patch 120*b* is provided on the other surface of the second ceramic member 110*b*, and the third patch 120*c* is provided on one surface of the second ceramic member 110*b*.

The first ceramic member 110*a* and the second ceramic member 110*b* of the array antenna 1000 may be bonded to each other through the insertion member 110*c*. The insertion member 110*c* may function and operate as a bonding layer for bonding the first ceramic member 110*a* and the second ceramic member 110*b* to each other.

The insertion member 110*c* is formed to cover one surface of the first ceramic member 110*a* and the other surface of the second ceramic member 110*b*, such that the first ceramic member 110*a* and the second ceramic member 110*b* may be overall bonded to each other. The insertion member 110*c* may be formed of, for example, a polymer, and for example, the polymer may include a polymer sheet. A dielectric constant of the insertion member 110*c* may be lower than that the dielectric constants of the first ceramic member 110*a* and the second ceramic member 110*b*. As an example, the dielectric constant of the insertion member 110*c* is 2 to 3 at 28 GHz. The thickness of the insertion member 110*c* may be 50 to 200 μm.

According to an example, the first ceramic member 110*a* and the second ceramic member 110*b* are formed of a material having a dielectric constant higher than that of the mounting board 10 to reduce the size of the array antenna module 1, and a material having a dielectric constant lower than that of the first ceramic member 110*a* and the second ceramic member 110*b* is provided between the first ceramic member 110*a* and the second ceramic member 110*b*, to lower an overall dielectric constant of the array antenna 1000, thereby improving radiation efficiency and gain.

As illustrated in FIG. 1, the array antenna 1000 may include a plurality of unit antennas 100*a*, 100*b*, 100*c* and 100*d* arranged in a structure of n×1 (n is a natural number of 2 or more). As an example, the plurality of unit antennas 100*a*, 100*b*, 100*c* and 100*d* may be arranged in an X axis direction. According to an example, the plurality of unit antennas 100*a*, 100*b*, 100*c* and 100*d* may be arranged in a structure of n×m (n is a natural number of 2 or more, and m is a natural number of 2 or more). The plurality of unit antennas 100*a*, 100*b*, 100*c* and 100*d* may be arranged in the X axis direction and the Y axis direction.

The RF signal used in the 5G communication system has a shorter wavelength and greater energy than those of the RF signal used in the 3G/4G communication system. Therefore, to significantly reduce interference between RF signals transmitted and received by the plurality of respective unit antennas 100*a*, 100*b*, 100*c* and 100*d*, the plurality of unit antennas 100*a*, 100*b*, 100*c* and 100*d* need to have a sufficient separation distance therebetween.

As an example, centers of the plurality of unit antennas 100*a*, 100*b*, 100*c* and 100*d* are sufficiently spaced apart by λ/2 to significantly reduce interference of RF signals transmitted and received by the plurality of respective unit antennas 100*a*, 100*b*, 100*c* and 100*d*, such that the array antenna 1000 may be used in a 5G communication system. In this case, A represents the wavelength of RF signals transmitted and received by the array antennas 1000.

However, as miniaturization of the antenna device is required, the plurality of unit antennas 100*a*, 100*b*, 100*c* and 100*d* of the array antenna 1000 may not secure a sufficient separation distance. Therefore, in a case in which the sufficient separation distance is not secured, it is necessary to reduce interference between the plurality of unit antennas 100*a*, 100*b*, 100*c* and 100*d*.

Figure 6:
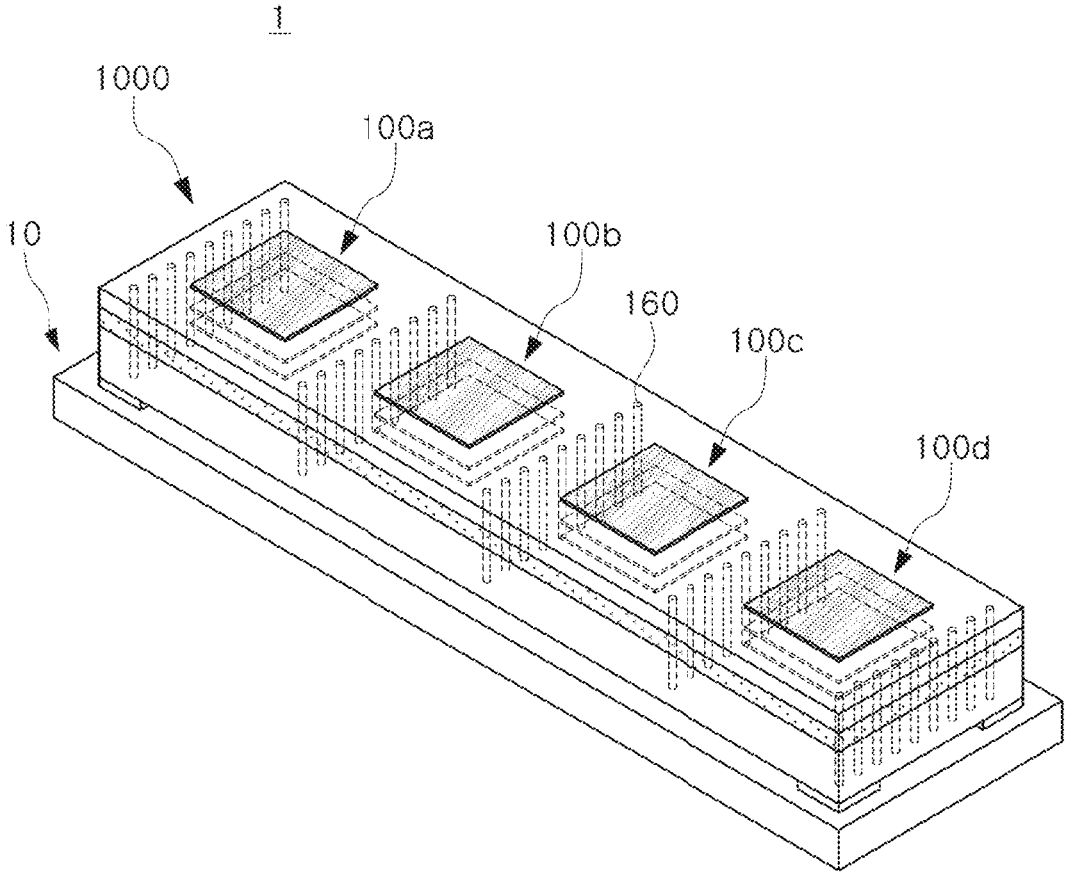
FIGS. 6, 7, 8 and 9 are perspective views of an array antenna including shielding vias according to various examples.

FIGS. 6, 7, 8 and 9 are perspective views of array antennas including shielding vias according to various examples, and FIGS. 10, 11, 12 and 13 are cross-sectional views of an array antenna of FIG. 6 according to various examples.

Figure 7:
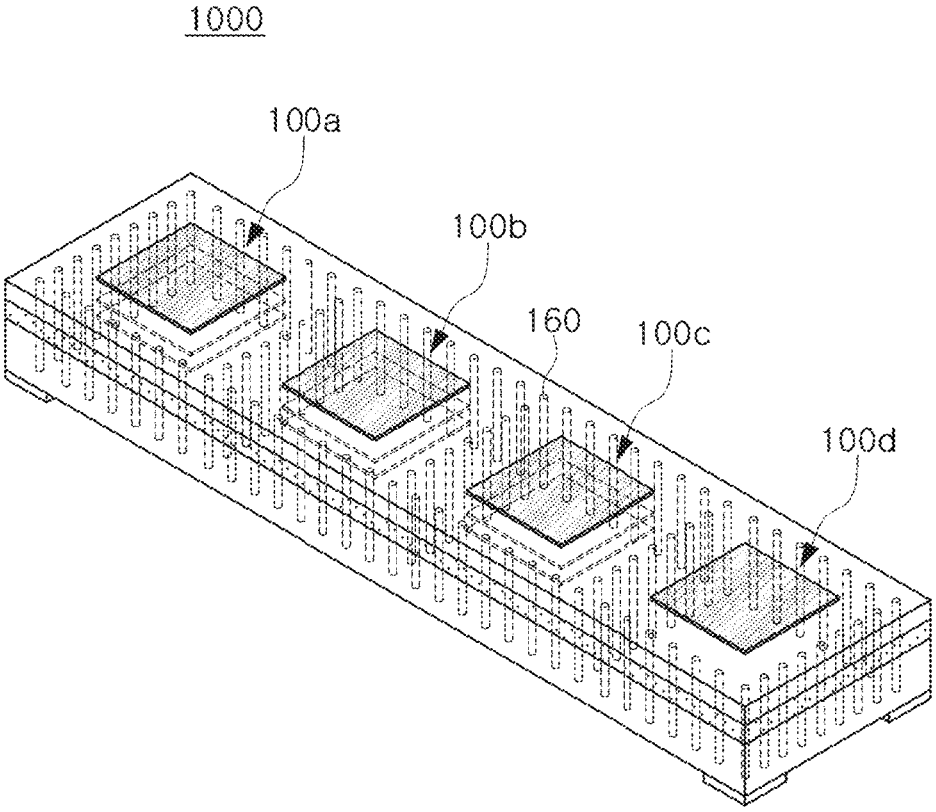
Figure 8:
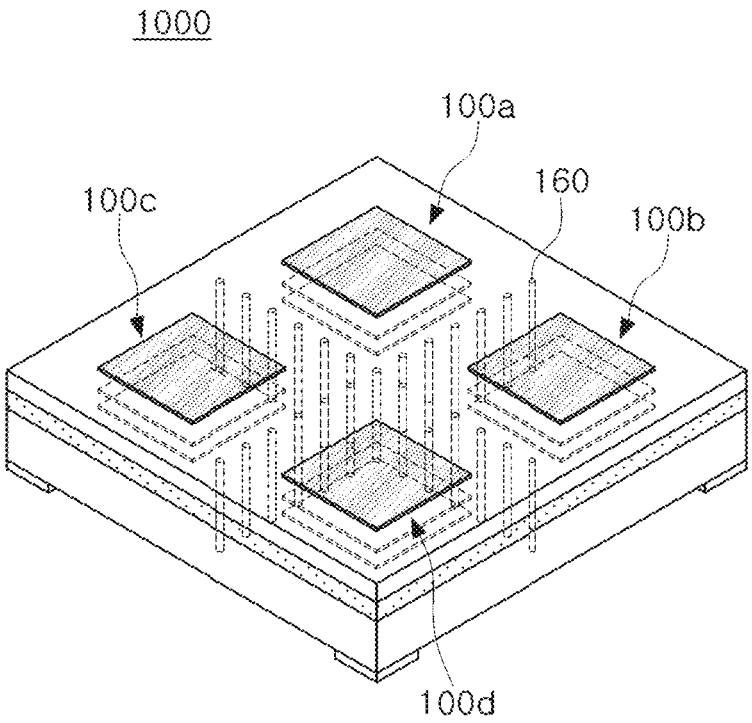
Figure 9:
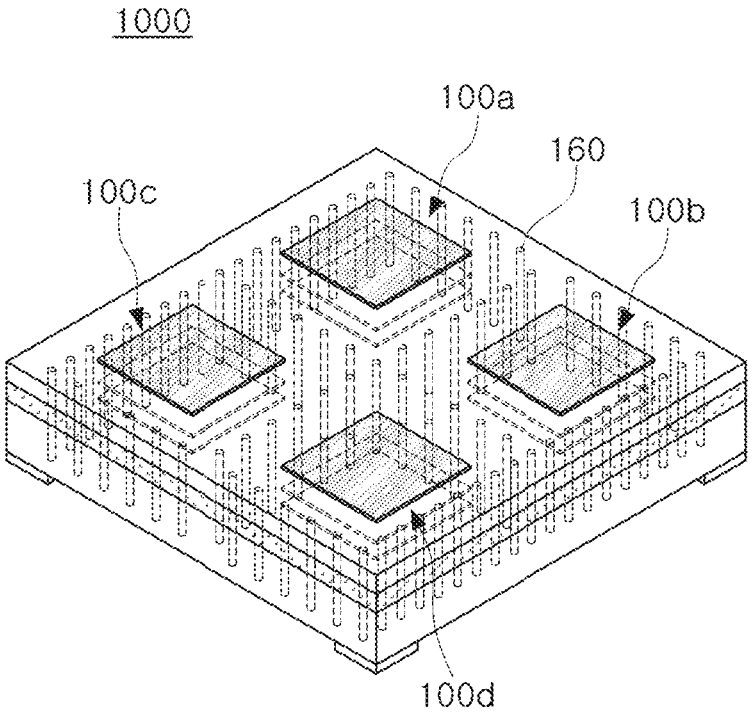

FIGS. 6 and 7 illustrate a plurality of unit antennas 100*a*, 100*b*, 100*c* and 100*d* arranged in a structure of n (n: natural number of 2 or more)×1, and FIGS. 8 and 9 illustrate a plurality of unit antennas 100*a*, 100*b*, 100*c* and 100*d* arranged in a structure of n (n: natural number of 2 or more)×m (m: natural number of 2 or more).

An array antenna 1000 according to an example may include a plurality of shielding vias 160.

Referring to FIGS. 6, 7, 8 and 9, the plurality of shielding vias 160 are disposed between adjacent unit antennas among the plurality of unit antennas 100*a*, 100*b*, 100*c* and 100*d*. As an example, the plurality of shielding vias 160 may be disposed between a first unit antenna 100*a* and a second unit antenna 100*b*.

The plurality of shielding vias 160 are disposed along a boundary between adjacent unit antennas among the plurality of unit antennas 100*a*, 100*b*, 100*c* and 100*d*. In this case, the boundary between two adjacent unit antennas of the plurality of unit antennas may be understood as a position in which the distances thereof from respective antenna pattern portions of the two adjacent unit antennas are the same as each other. For example, the plurality of shielding vias 160 may be disposed along a boundary between the first unit antenna 100*a* and the second unit antenna 100*b*.

Referring to FIGS. 7 and 9, the plurality of shielding vias 160 are disposed to surround each of the plurality of unit antennas 100*a*, 100*b*, 100*c* and 100*d*. In this case, the plurality of shielding vias 160 are disposed to surround each of the plurality of unit antennas 100*a*, 100*b*, 100*c* and 100*d*, in such a manner that the two adjacent unit antennas may share a portion of the plurality of shielding vias 160, such that the plurality of shielding vias 160 corresponding to each of the two adjacent unit antennas do not overlap.

When viewed in the thickness direction of the antenna substrate 110, the plurality of shielding vias 160 may surround each of the plurality of unit antennas 100*a*, 100*b*, 100*c* and 100*d* in a rectangular shape. According to examples, the plurality of shielding vias 160 may surround the plurality of unit antennas 100*a*, 100*b*, 100*c* and 100*d* in various shapes such as a circle or the like. In addition, according to examples, the plurality of shielding vias 160 may be interconnected to surround the plurality of unit antennas 100*a*, 100*b*, 100*c* and 100*d* in a plate shape.

The plurality of shielding vias 160 may penetrate through the antenna substrate 110 in the thickness direction. The plurality of shielding vias 160 extend in the thickness direction of the antenna substrate 110 and are provided inside the antenna substrate 110.

Figure 10:
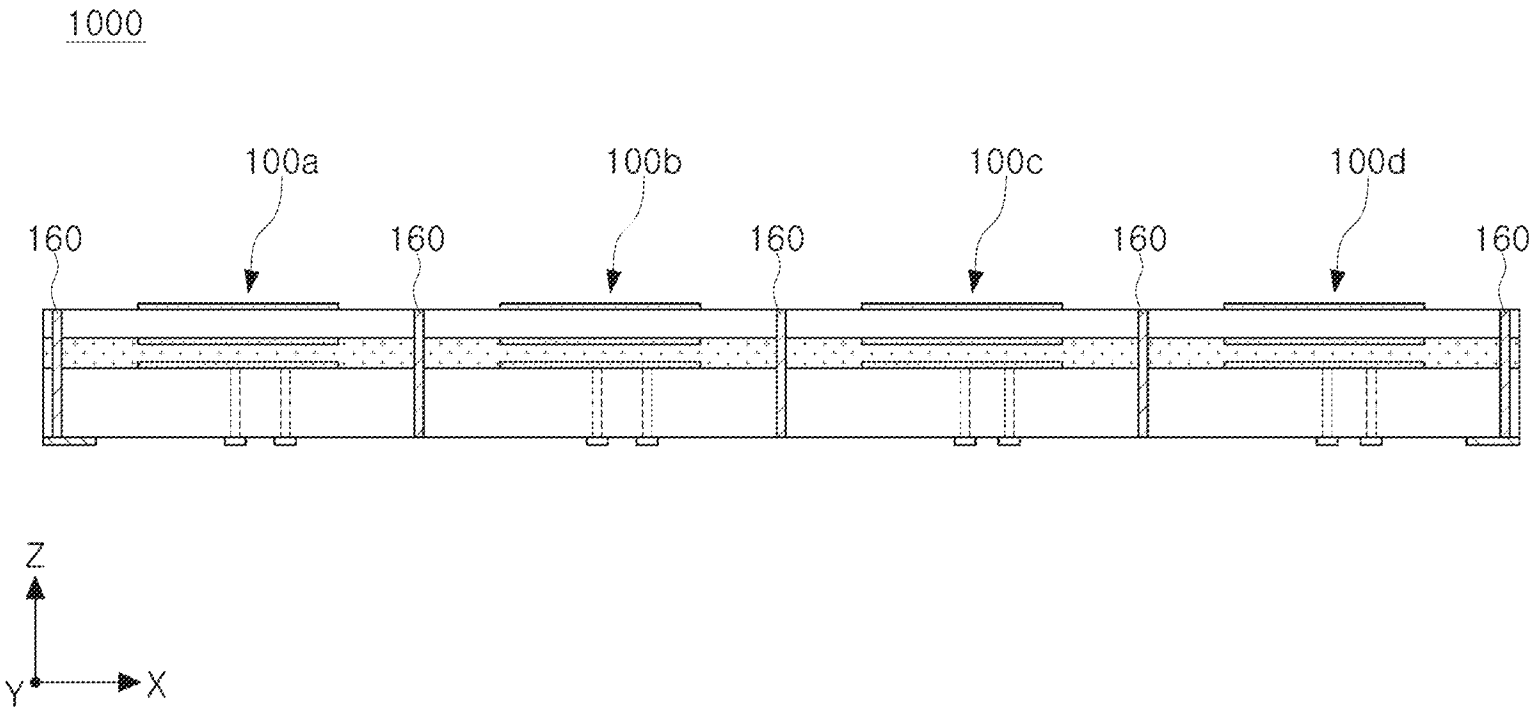
FIGS. 10, 11, 12 and 13 are cross-sectional views of the array antenna of FIG. 6 according to various examples.

Referring to FIG. 10, the plurality of shielding vias 160 penetrates through the first ceramic member 110*a*, the second ceramic member 110*b* and the insertion member 110*c* of the antenna substrate 110 in the thickness direction, to be exposed to at least one of upper and lower surfaces of the antenna substrate 110.

The plurality of shielding vias 160 may be provided in a thickness region of the antenna substrate 110 corresponding to the antenna pattern portion 120.

Figure 11:
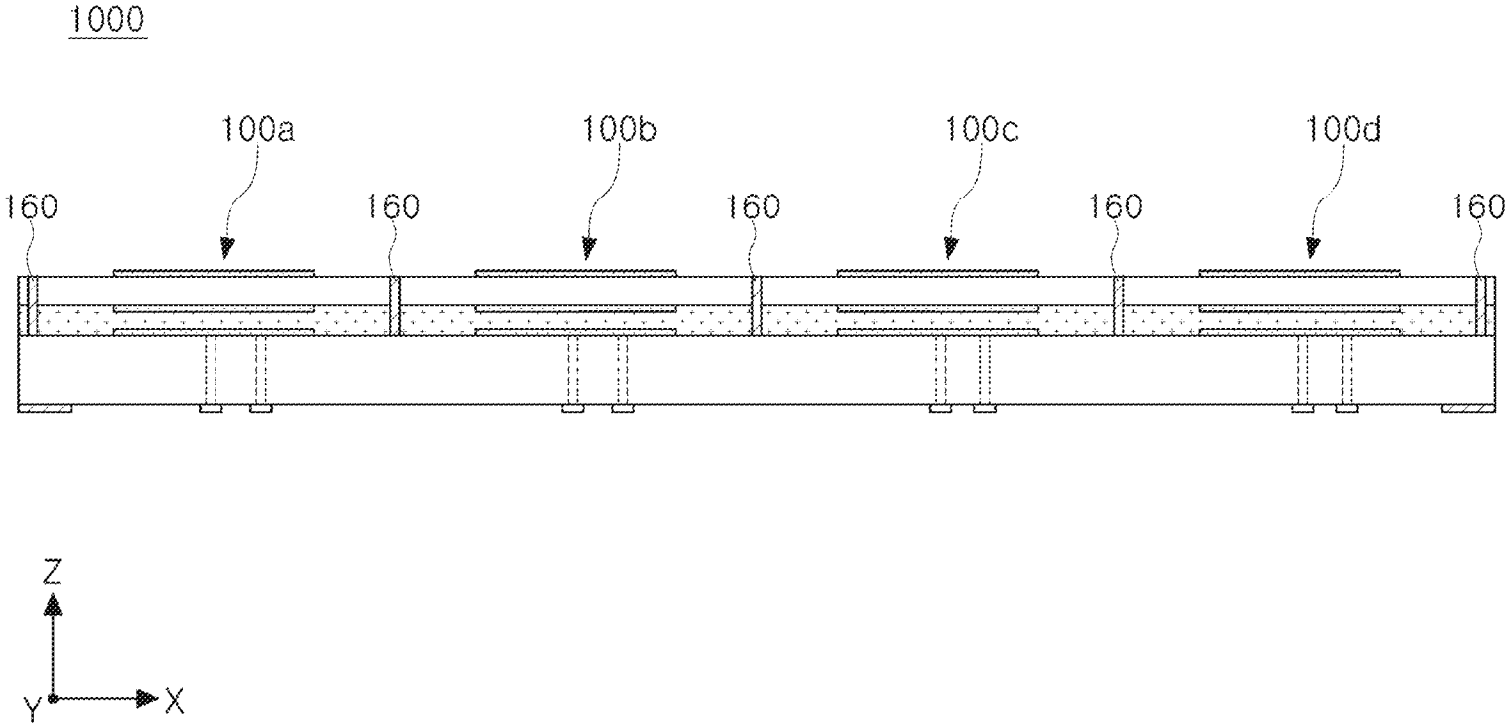

As an example, referring to FIG. 11, when the antenna pattern portion 120 includes a first patch 120*a* and a second patch 120*b*, the plurality of shielding vias 160 may extend from one surface of the first ceramic member 110*a*, on which the first patch 120*a* is provided, to the other surface of the second ceramic member 110*b*, on which the second patch 120*b* is provided.

Figure 12:
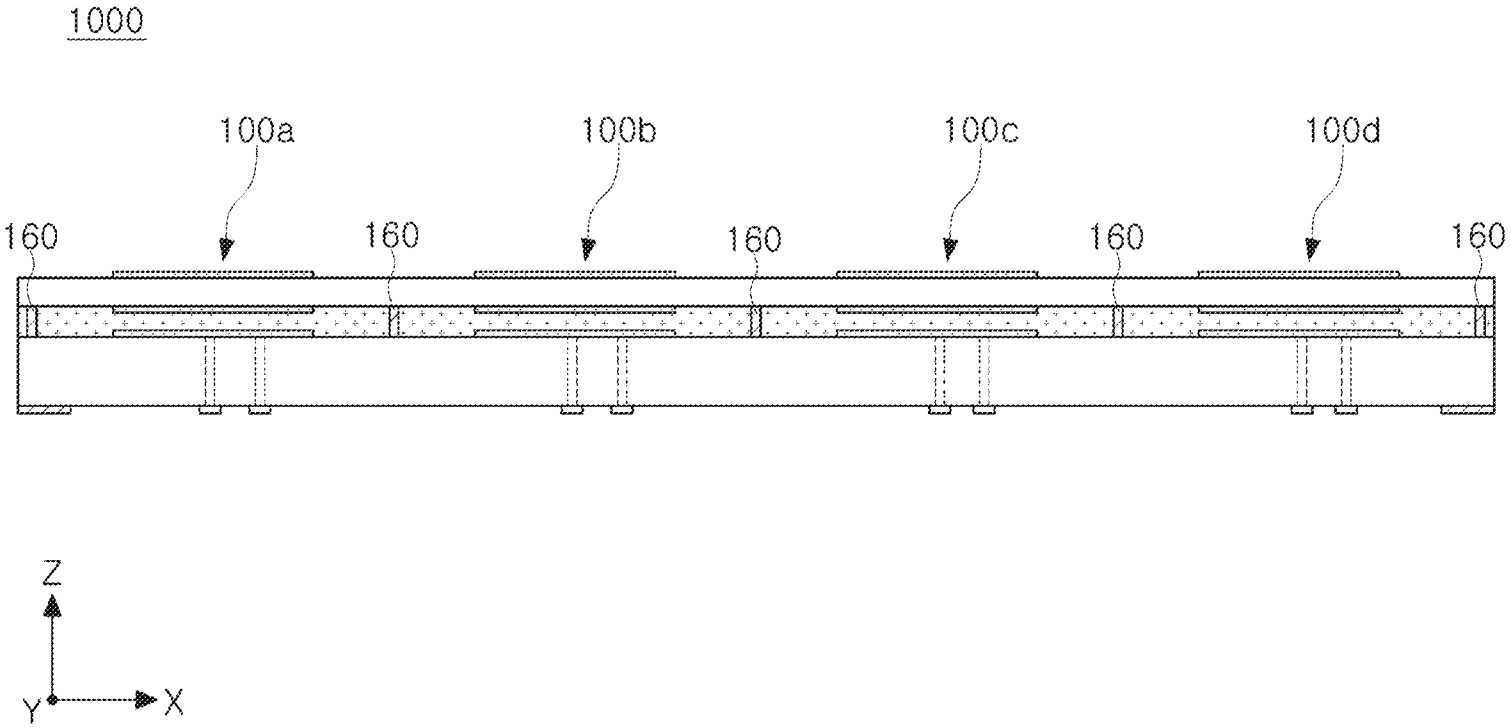

As another example, referring to FIG. 12, when the antenna pattern portion 120 includes the first patch 120*a* and a third patch 120*c*, or the antenna pattern portion 120 includes the first patch 120*a*, the second patch 120*b* and the third patch 120*c*, the plurality of shielding vias 160 may extend from one surface of the first ceramic member 110*a* on which the first patch 120*a* is provided to one surface of the second ceramic member 110*b* on which the third patch 120*c* is provided.

Figure 13:
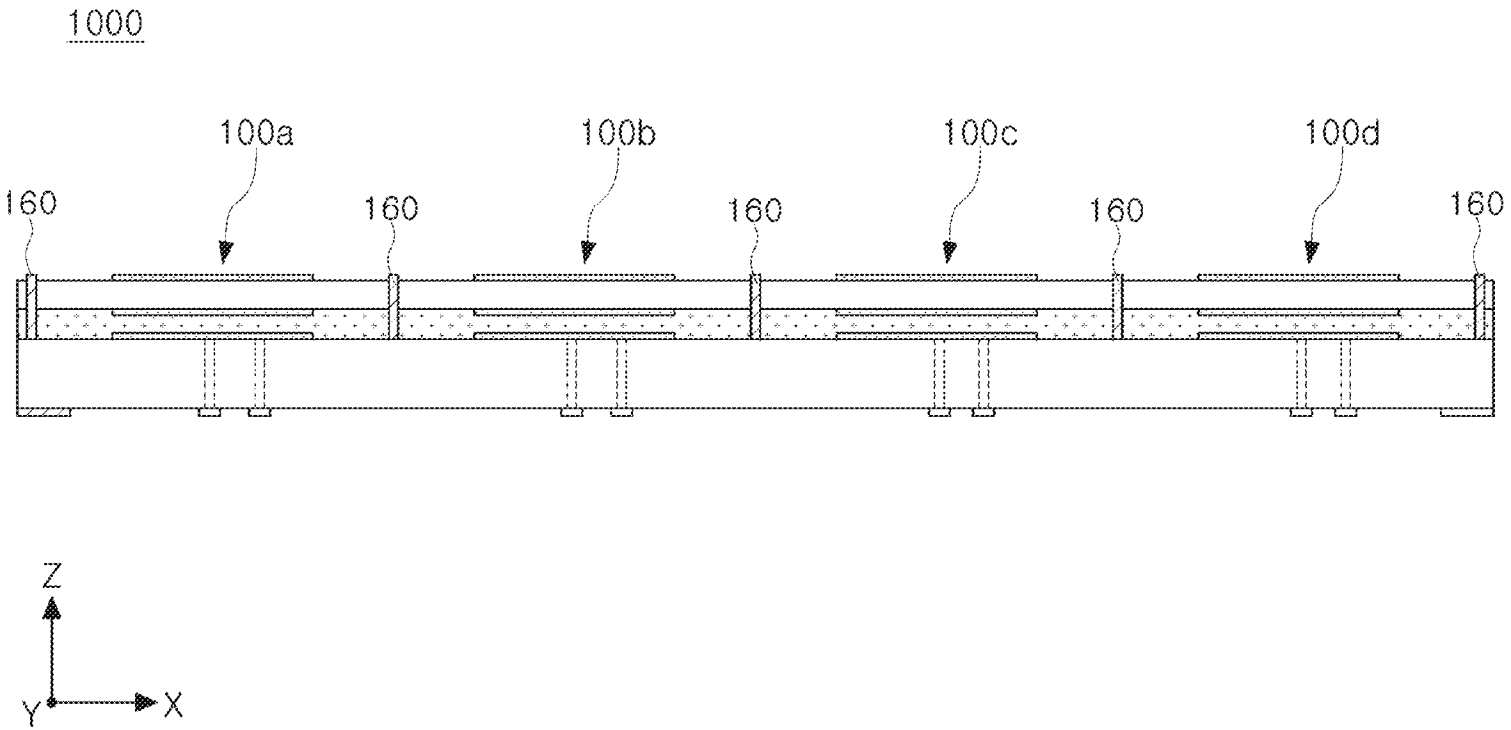

As another example, referring to FIG. 13, when the antenna pattern portion 120 includes the first patch 120*a* and the third patch 120*c*, or the antenna pattern portion 120 includes the first patch 120*a*, the second patch 120*b* and the third patch 120*c*, the plurality of shielding vias 160 may extend from one surface of the first ceramic member 110*a* on which the first patch 120*a* is provided to a position corresponding to the thickness of the third patch 120*c*, to protrude from the second ceramic member 110*b*.

Figure 14:
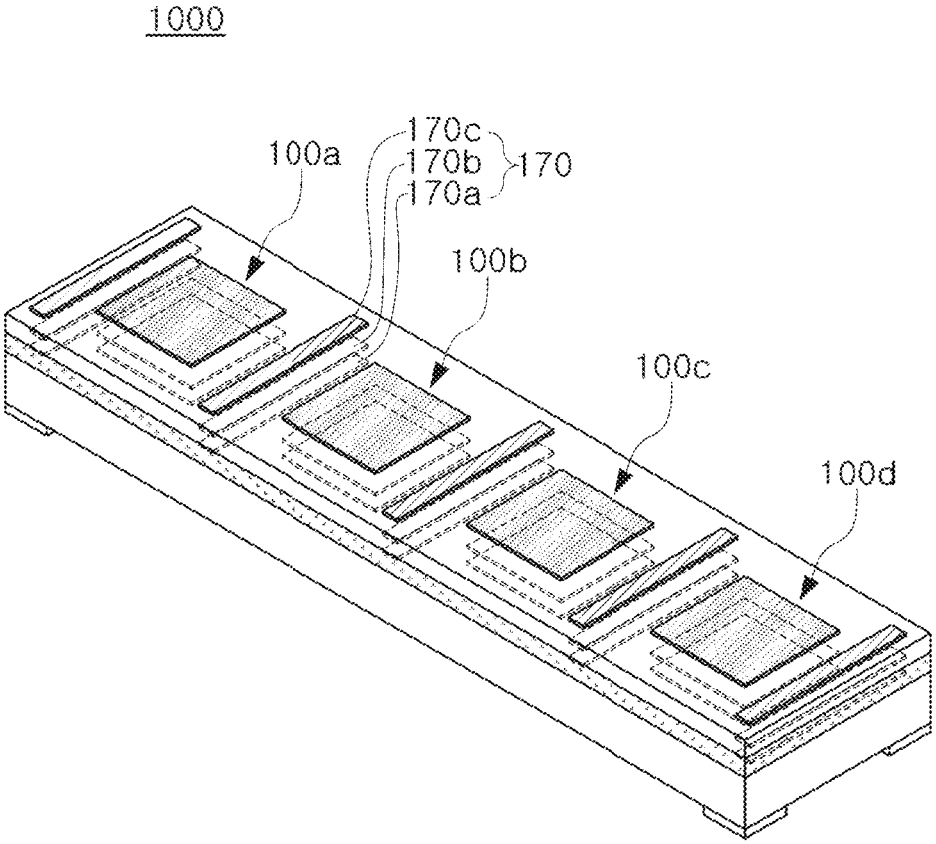
FIGS. 14, 15, 16 and 17 are perspective views of array antennas including shielding electrodes according to various examples.
Figure 16:
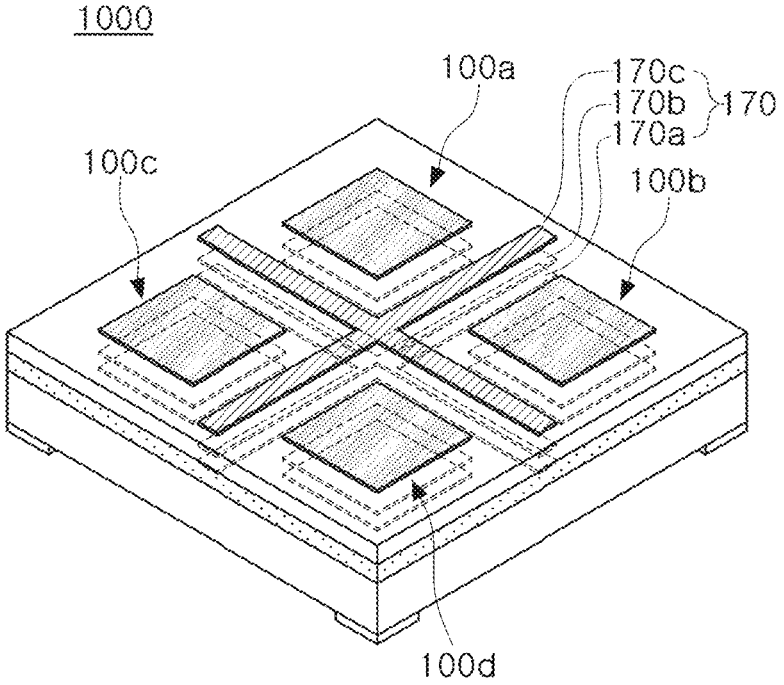
Figure 17:
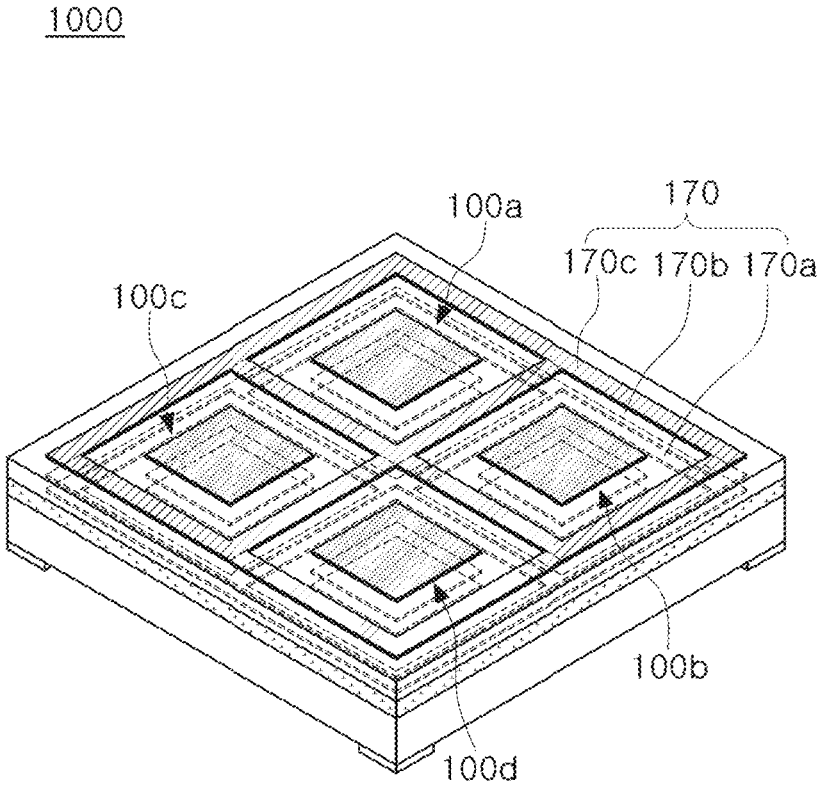
Figure 18:
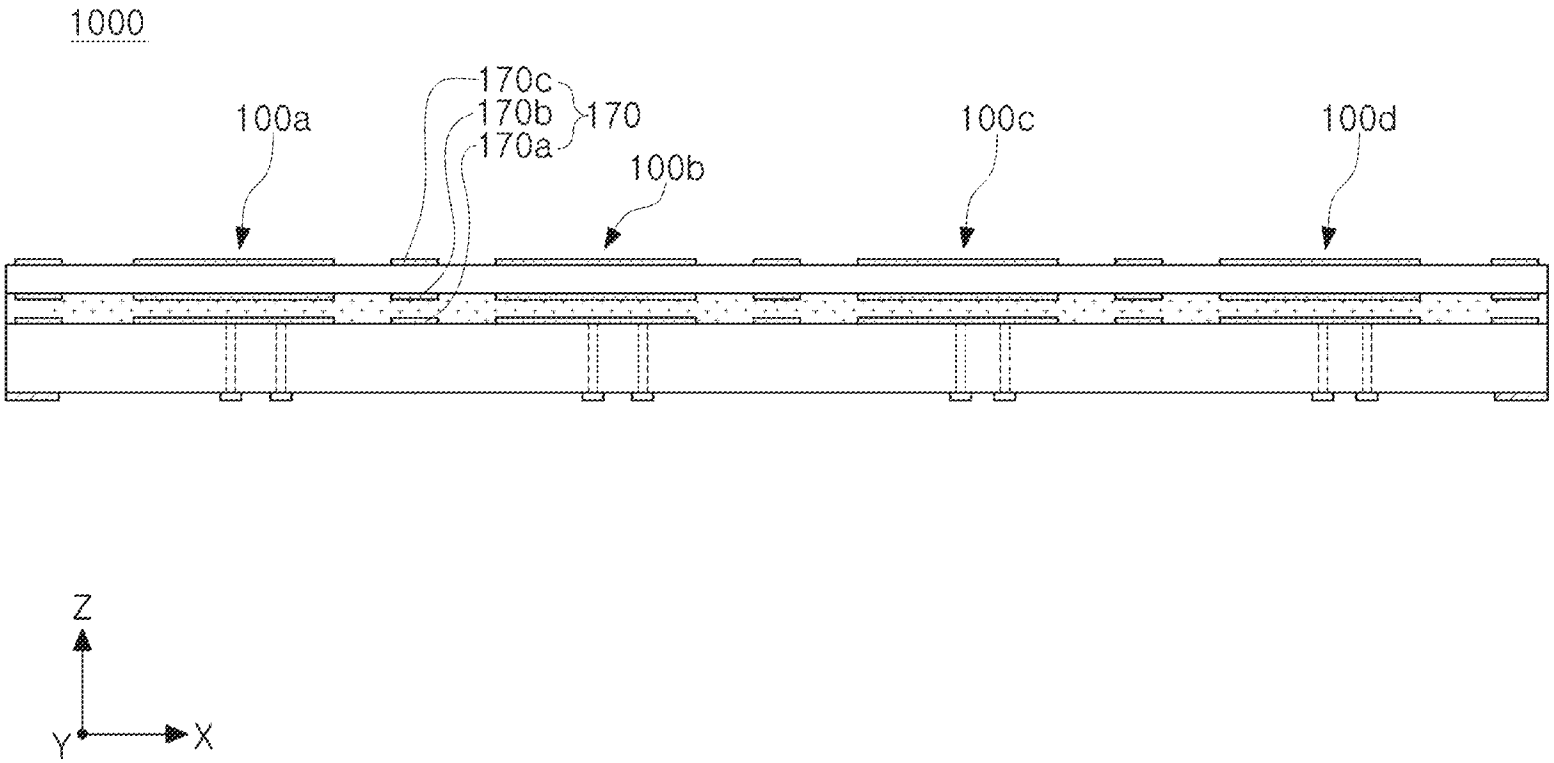
FIG. 18 is a cross-sectional view of the array antenna of FIG. 14.

FIGS. 14, 15, 16 and 17 are perspective views of array antennas including shielding electrodes according to various examples, and FIG. 18 is a cross-sectional view of an array antenna of FIG. 14.

Figure 15:
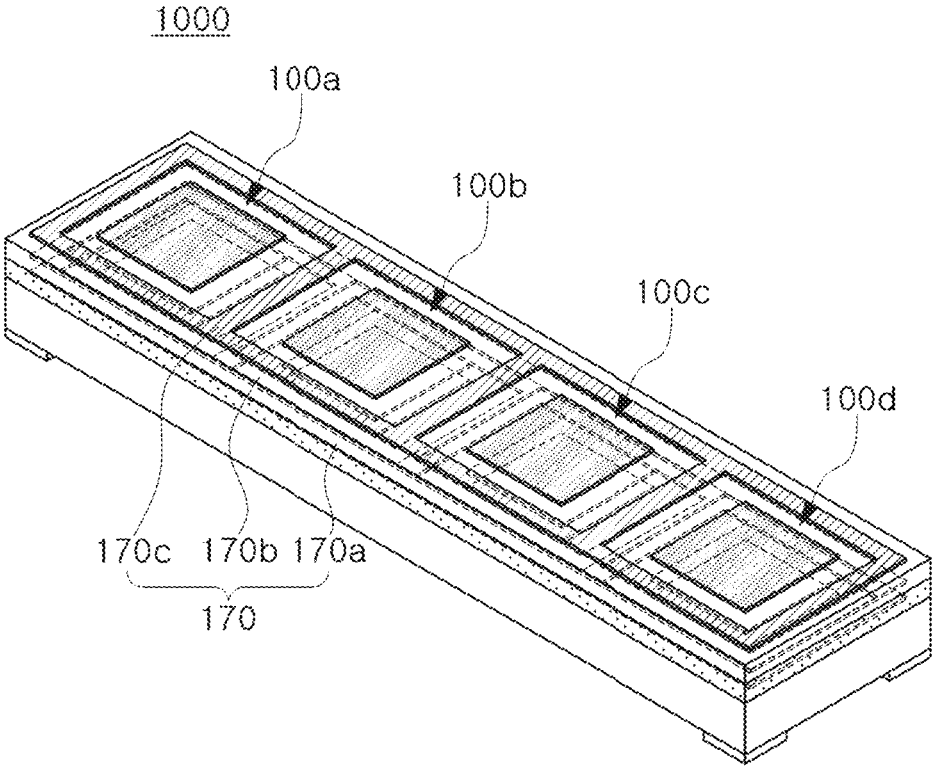

FIGS. 14 and 15 illustrate a plurality of unit antennas 100*a*, 100*b*, 100*c* and 100*d* arranged in a structure of n (n: natural number of 2 or more)×1, and FIGS. 16 and 17 illustrate a plurality of unit antennas 100*a*, 100*b*, 100*c* and 100*d* arranged in a structure of n (n: natural number of 2 or more)×m (m: natural number of 2 or more).

An array antenna 1000 according to an example may include a plurality of shielding electrodes 170.

The plurality of shielding electrodes 170 may include a first shielding electrode 170*a* and may include at least one of a second shielding electrode 170*b* and a third shielding electrode 170*c*. The first shielding electrode 170*a*, the second shielding electrode 170*b*, and the third shielding electrode 170*c* may be formed to have the same shape in a thickness direction of the antenna substrate 110.

Referring to FIG. 18, the first shielding electrode 170*a* is provided on the same layer as a layer of the first patch 120*a*, the second shielding electrode 170*b* is provided on the same layer as that of the second patch 120*b*, and the third shielding electrode 170*c* is provided on the same layer as that of the third patch 120*c*. As an example, when the second patch 120*b* is formed on the array antenna 1000, the second shielding electrode 170*b* may be provided on the same layer as the second patch 120*b*, and when the third patch 120*c* is formed on the array antenna 1000, the third shielding electrode 170*c* may be provided on the same layer as the third patch 120*c*.

Referring to FIGS. 14, 15, 16 and 17, the plurality of shielding electrodes 170 are disposed between adjacent unit antennas among the plurality of unit antennas 100*a*, 100*b*, 100*c* and 100*d*. For example, the plurality of shielding electrodes 170 may be disposed between the first unit antenna 100*a* and the second unit antenna 100*b*.

The plurality of shielding electrodes 170 extends along a boundary between adjacent unit antennas among the plurality of unit antennas 100*a*, 100*b*, 100*c* and 100*d*. In this case, the boundary between two adjacent unit antennas of the plurality of unit antennas may be understood as a position in which the distances thereof from respective antenna pattern portions of the two adjacent unit antennas are the same as each other. For example, the plurality of shielding vias 170 is disposed along a boundary between the first unit antenna 100*a* and the second unit antenna 100*b*.

Referring to FIGS. 15 and 17, the plurality of shielding electrodes 170 are disposed to surround each of the plurality of unit antennas 100*a*, 100*b*, 100*c* and 100*d*. In this case, the plurality of shielding electrodes 170 is disposed to surround each of the plurality of unit antennas 100*a*, 100*b*, 100*c* and 100*d*, in such a manner that two adjacent unit antennas may share a portion of the plurality of shielding electrodes 170, such that the plurality of shielding electrodes 170 corresponding to each of the two adjacent unit antennas do not to overlap.

As set forth above, according to the example, the radiation efficiency may be improved by reducing interference between the unit antennas arranged in an array form.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed to have a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An array antenna comprising:

an antenna substrate comprising a first ceramic member, an insertion member, and a second ceramic member stack;

antenna pattern portions arranged on the antenna substrate in an array form, wherein a surface of the first ceramic member and opposing surfaces of the second ceramic member each has a patch of the antenna pattern portions disposed thereon; and shielding vias disposed inside the antenna substrate and extending in a thickness direction of the antenna substrate, wherein the plurality of shielding vias are disposed in thickness areas of the antenna substrate corresponding to the antenna pattern portions.

2. The array antenna of claim 1, wherein each of the antenna pattern portions, and unit regions of the antenna substrate corresponding to the antenna pattern portions, define a plurality of unit antennas.

3. The array antenna of claim 2, wherein the shielding vias are disposed between adjacent unit antennas.

4. The array antenna of claim 3, wherein the shielding vias are disposed along a boundary between the adjacent unit antennas, and distances of the boundary from antenna pattern portions of the adjacent unit antennas are equal to each other.

5. The array antenna of claim 2, wherein the shielding vias are arranged to surround each of the unit antennas.

6. The array antenna of claim 5, wherein the shielding vias are disposed to surround each of the unit antennas such that adjacent unit antennas share a portion of the shielding vias such that shielding vias corresponding to each of the adjacent unit antennas do not overlap.

7. The array antenna of claim 1, wherein each of the antenna pattern portions comprises:

a first patch disposed on a first surface of the first ceramic member; and a second patch disposed on a first surface of the second ceramic member facing the first ceramic member.

8. The array antenna of claim 7, wherein the shielding vias extend from the first surface of the first ceramic member to the first surface of the second ceramic member.

9. The array antenna of claim 1, wherein each of the antenna pattern portions comprises:

a first patch provided on a first surface of the first ceramic member; and a second patch provided on a second surface of the second ceramic member opposite to the first ceramic member.

10. The array antenna of claim 9, wherein the shielding vias extend from the first surface of the first ceramic member to the second surface of the second ceramic member.

11. The array antenna of claim 9, wherein the shielding vias extend from the first surface of the first ceramic member to a position corresponding to a thickness of the second patch to protrude from the second ceramic member.

12. An array antenna comprising:

an antenna substrate comprising a first ceramic member, an insertion member, and a second ceramic member stack;

antenna pattern portions arranged on the antenna substrate in an array form; and shielding electrodes disposed on the first ceramic member and the second ceramic member, wherein each of the antenna pattern portions, and unit regions of the antenna substrate corresponding to the antenna pattern portions, form a plurality of unit antennas, and the shielding electrodes are disposed between adjacent unit antennas, wherein a surface of the first ceramic member and opposing surfaces of the second ceramic member each has a patch of the antenna pattern portions disposed thereon.

13. The array antenna of claim 12, wherein the shielding electrodes are disposed along a boundary between the adjacent unit antennas, and distances of the boundary from antenna pattern portions of the adjacent unit antennas are equal to each other.

14. The array antenna of claim 12, wherein the shielding electrodes are disposed to surround each of the unit antennas.

15. The array antenna of claim 14, wherein the shielding electrodes are disposed to surround each of the unit antennas such that the adjacent unit antennas share a portion of the shielding electrodes such that shielding electrodes corresponding to each of the adjacent unit antennas do not overlap.

16. The array antenna of claim 12, wherein each of the unit antennas comprises:

a first patch disposed on the first ceramic member; and a second patch disposed on the second ceramic member.

17. The array antenna of claim 16, wherein the shielding electrodes comprise a first shielding electrodes disposed on a same layer of the antenna substrate as a layer of the first patch, and second shielding electrodes disposed on a same layer of the antenna substrate as a layer of the second patch.

18. An array antenna comprising:

an antenna substrate comprising a first ceramic layer, a second ceramic layer disposed on the first ceramic layer, and an insertion layer disposed between the first ceramic layer and the second ceramic layer;

unit antennas disposed on the antenna substrate, each unit antenna comprising a first patch disposed at a boundary between the first ceramic layer and the insertion layer and a second patch disposed on a surface of the second ceramic layer and at least partially overlapping the first patch in a thickness direction of the antenna substrate; and shielding elements disposed at least partially inside the antenna substrate and between adjacent unit antennas, the shielding elements at least partially overlapping each of the first patches in at least one direction orthogonal to the thickness direction of the antenna substrate, wherein the shielding elements comprise first shielding electrodes disposed at a boundary between the first ceramic layer and the insertion layer and second electrodes disposed on the surface of the second ceramic layer on which the second patch is disposed.

19. The array antenna of claim 18, wherein the shielding elements comprise shielding vias that extend from a surface of the first ceramic layer that forms the boundary between the first ceramic layer and the insertion layer to the surface of the second ceramic layer on which the second patch is disposed.

20. The array antenna of claim 1, wherein a bonding pad is disposed on another surface of the first ceramic member.

21. The array antenna of claim 1, wherein a dielectric constant of the insertion member is lower than dielectric constants of the first ceramic member and the second ceramic member.

22. The array antenna of claim 12, wherein the shielding electrodes are disposed on the surface of the first ceramic member and the opposing surfaces of the second ceramic member.

* * * * *